United States Patent [19]

Austin

[11] 4,137,800

[45] Feb. 6, 1979

[54] TORQUE WRENCH

[75] Inventor: George A. Austin, Noble Park, Australia

[73] Assignee: Harmat Nominees Pty. Ltd., Australia

[21] Appl. No.: 827,106

[22] Filed: Aug. 23, 1977

[30] Foreign Application Priority Data

Aug. 23, 1976 [AU] Australia ..... PC7106

[51] Int. Cl.[2] ..... B25B 13/46

[52] U.S. Cl. ..... 81/57.39; 74/128; 91/342; 92/129; 74/625

[58] Field of Search ..... 81/57.39; 74/128, 25, 74/625; 173/108; 91/342; 92/129

[56] References Cited

U.S. PATENT DOCUMENTS

| | | | |
|---|---|---|---|
| 2,627,248 | 2/1953 | Shaff | 91/342 |
| 2,758,569 | 8/1956 | Peterson | 91/342 |
| 2,961,904 | 11/1960 | Sergan | 81/57.39 |
| 3,211,028 | 10/1965 | Christensson | 81/52.3 |
| 3,216,158 | 11/1965 | Kelsey | 91/342 |
| 3,844,197 | 10/1974 | Kramer et al. | 91/342 |

*Primary Examiner*—James L. Jones, Jr.
*Attorney, Agent, or Firm*—Larson, Taylor & Hinds

[57] ABSTRACT

There is disclosed a torque wrench, including a main body, an actuator including a piston/cylinder arrangement and cooperating spool valve which selectively supplies pressurized fluid to either side of the piston member. The actuator is supported in the main body and adapted to act upon and selectively reciprocate a thrust member relative to the main body, the thrust member being adapted to engage and pivot a torque arm for providing a torque output at an output shaft via a ratchet arrangement incorporated between the torque arm and the output shaft. The torque arm is supported independently of the thrust member and is not physically connected thereto. The exposed area of the piston member on a return side thereof is relatively smaller than the exposed area on the opposite or power side thereof, whereby the swept volume during a return stroke is relatively smaller than the swept volume during a power stroke, to thereby produce a low force relatively high speed return stroke and a high force relatively low speed power stroke. A return spring biases the torque arm to a home position during a return stroke of the piston member. The torque arm has a curved surface adapted for engagement by a correspondingly curved surface on the thrust member to maintain high force transmitting area contact as distinct from point or line contact. Means are also provided to measure the amount of rotation of the output shaft to allow utilization of the "turn of nut" technique often used with torque wrenches.

12 Claims, 6 Drawing Figures

Figure 2:
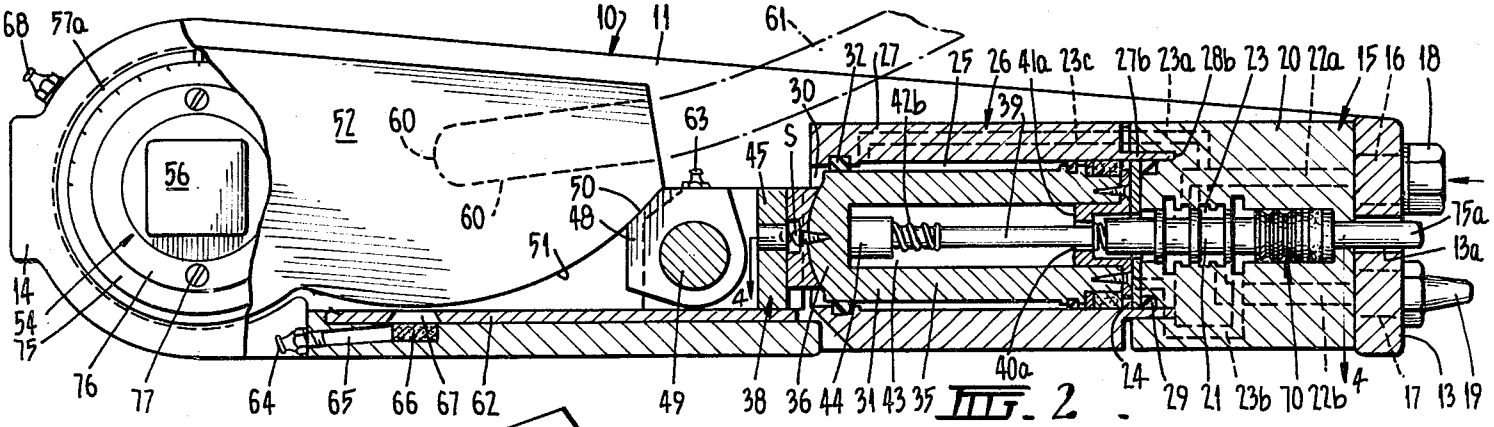

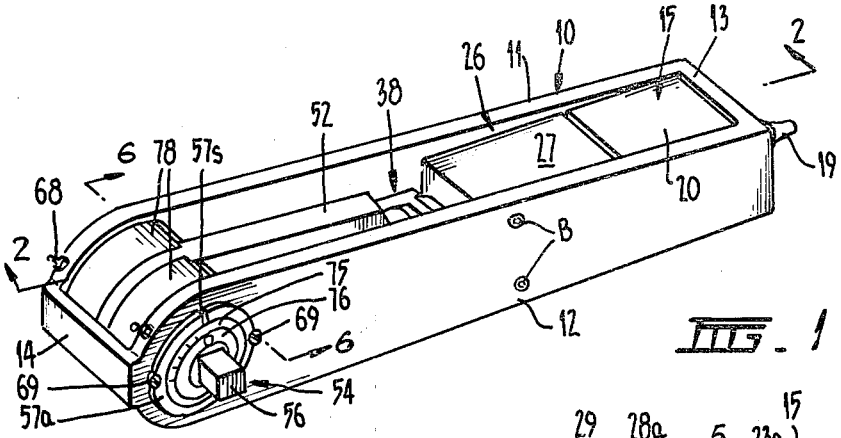
FIG. 1.
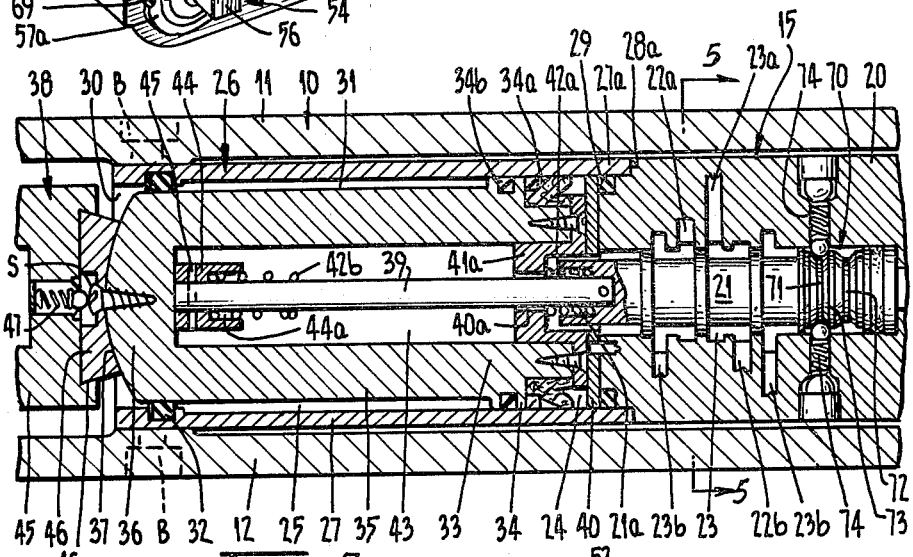
FIG. 4.
FIG. 5.
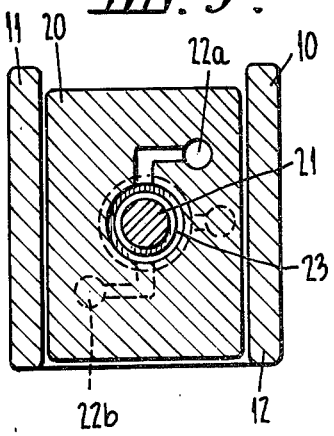
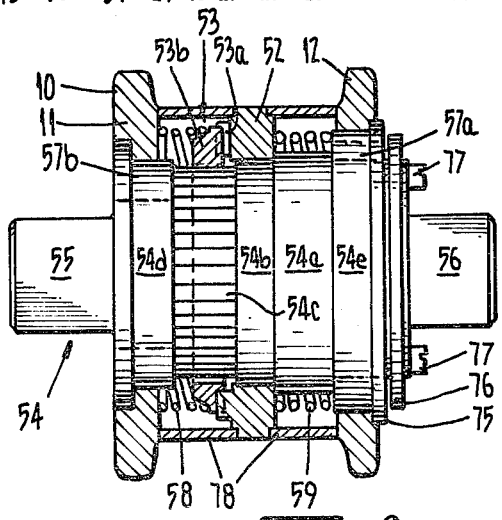
FIG. 6.

TORQUE WRENCH

This invention relates to a torque wrench, and more particularly a torque wrench of the type having an actuator adapted to act upon and selectively move a thrust member adapted to engage and pivot a torque arm for providing a torque output at an output shaft via a ratchet arrangement incorporated between said torque arm and said output shaft.

It is a basic objective of the present invention to provide an arrangement in which the torque arm is supported independently of the thrust member, and is not physically connected thereto, thus allowing the torque arm to be operated independently of the actuator and thrust member if required.

The invention therefore envisages a torque wrench, including a main body, an actuator supported in said body and adapted to act upon and selectively reciprocate a thrust member relative to said body, said thrust member being adapted to engage and pivot a torque arm for providing a torque output at an output shaft via a ratchet arrangement incorporated between said torque arm and said output shaft, wherein the torque arm is supported independently of the thrust member and is not physically connected thereto.

With such an arrangement the torque arm may incorporate a provision to detachably connect an extension handle whereby a torque output may be manually applied to said output shaft independently of said actuator.

Such a facility is possible with the wrench according to the present invention in view of the fact that the torque arm is supported independently of the thrust member and thus can be operated independently thereof. A user of the wrench is therefore able to override the hydraulic actuator section of the wrench to pretighten nut and bolt assemblies as with a normal hand operated ratchet wrench. This is particularly useful in many applications where many turns of a nut or bolt are necessary initially before any high tightening force is required.

This feature also allows a user to pretighten the nut or bolt assembly with an alternative torque measuring device in series with the torque arm. Furthermore additional tightening over and above that provided by the actuator section of the wrench can be controlled independently of the normal control by hydraulic pressure, that is, according to the "turn of nut" method often employed with torque wrenches. The user of the wrench, or the control engineer, therefore has at his disposal with the present wrench the alternative of considering how to control the degree of tightening of a nut and bolt assembly more readily than with known torque wrenches.

Preferably the torque arm has a curved surface adapted for engagement by a correspondingly curved surface on the thrust member, and the curved surface on said torque arm and the correspondingly curved surface on said thrust member are formed as arcs of circles based on the same radius.

Alternatively, the respective curved surfaces may be formed from specified cam surfaces other than arcs of circles, which in certain instances marginally increases the accuracy of the wrench, although somewhat limiting the load capacity of the wrench. With such a construction, at any time during operation of the wrench, line contact will exist between the torque arm and the thrust member, that is, the thrust member may comprise, or support, at least one roller. An alternative is to utilise a thrust member with any form of cam engaging surface thereon for engaging the cam surface on the torque arm.

Preferably a face of relatively large surface area on said thrust member is adapted to engage and slide along a slide support surface of the wrench body, whereby a large area of sliding contact is maintained to ensure that the large forces transmitted during use of the wrench are accommodated at the area of contact between said thrust member and said body. Alternatively the thrust member may carry a plurality of rollers which engage and roll along the adjacent surface of the body.

Preferably a wear plate in the form of an elongated strip of hardened steel is fixed to said body over the surface to be engaged by said thrust member, whereby wear on the body at this point will be kept to a minimum.

Preferably the actuator is a hydraulic actuator which includes a fixed hydraulic cylinder within which a piston member is received, and cooperating with a valve arrangement adapted to selectively supply hydraulic fluid under pressure to either side of said piston member to impart a linear reciprocating movement to said piston member and the thrust member with which it cooperates.

Preferably the exposed area of the piston member on the return side thereof is relatively smaller than the exposed area on the power side thereof, whereby the swept volume during return is relatively smaller than the swept volume in the power stroke.

Such a facility results in a high force power stroke at relatively low speed and a low force return stroke at relatively high speed, the effect of which is to significantly reduce the time taken to execute return strokes thus effectively reducing the overall cycle time.

A reduction in cycle time over conventional hydraulic torque wrenches of up to 45% may be possible with the preferred form of the present invention.

Preferably the torque arm cooperates with a return spring which biases the torque arm towards a home position when the thrust member is in the returned position, whereby upon completion of a power stroke and during return of said thrust member during a return stroke of the hydraulic actuator said torque arm will automatically return to a position adjacent said thrust member preparatory to a subsequent power stroke. Furthermore such a return spring also assists the user of the wrench during manual use of the wrench independently of the actuator as discussed previously.

Figure 3:
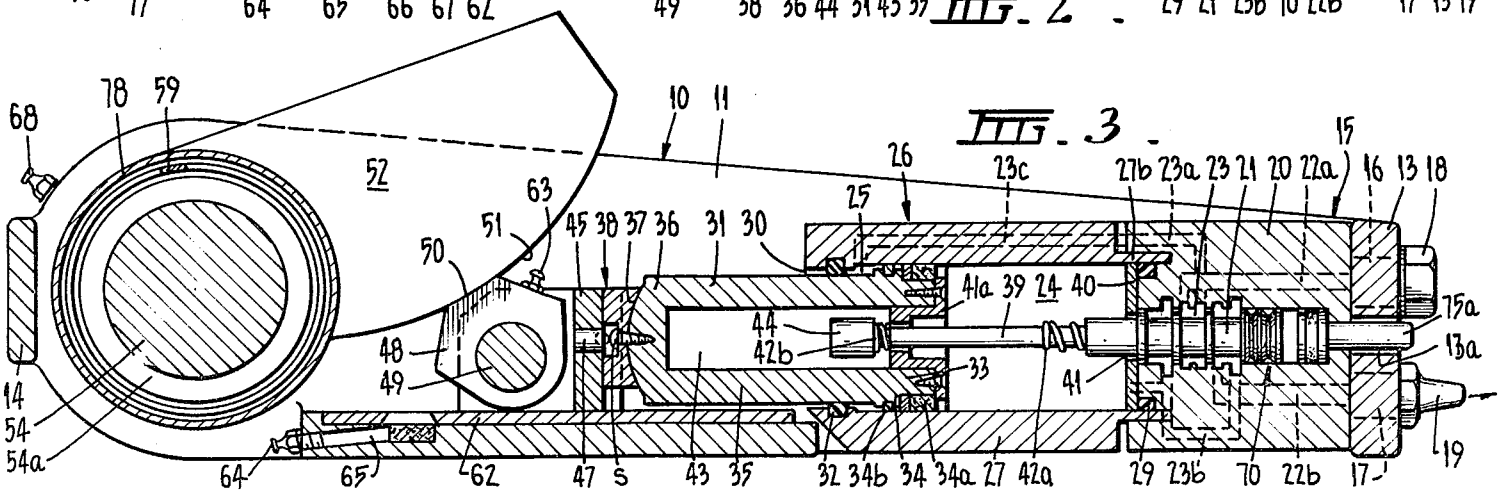

One preferred form of the invention will now be described with reference to the accompanying drawings in which:

FIG. 1 is a general perspective view of the torque wrench according to this preferred form of the invention, FIG. 2 is a side elevational view, partly in section, taken alone line 2—2 of FIG. 1, and with the actuator, and thrust member and torque arm in a retracted position during operation, FIG. 3 is a side elevational view similar to that of FIG. 2, but with the actuator, thrust member and torque arm in an advanced position during operation, FIG. 4 is a cross-sectional view taken along line 4—4 of FIG. 2, FIG. 5 is a cross-sectional view taken along line 5—5 of FIG. 4, and FIG. 6 is a cross-sectional view taken along line 6—6 of FIG. 1.

In this preferred form of the invention the wrench includes a unitary main body 10, comprising side walls 11 and 12, a first interconnecting end wall 13 adjacent a hydraulic actuator section to be later described, and a second interconnecting end wall at the torque output section of the wrench. The main body 10 is effectively an open cage with access to the interior being possible from the top and bottom as viewed in the direction of FIG. 1. The open cage like nature of the main body allows ready access to the parts of the wrench within the body for assembly, disassembly, inspection, adjustment and maintenance purposes.

The end wall 13 includes a pair of input and output ports 16 and 17 respectively therethrough for the supply and exhaust of pressurised hydraulic fluid into and out of the hydraulic actuator section (generally indicated as 15).

The input and output ports incorporate hydraulic connections 18 and 19 of the "quick connect" variety, which enables a user of the wrench to readily select to either motivate the wrench with a hydraulic pump (electrically or air driven) or use a manually operated hydraulic pump. With the hydraulic actuator 15 incorporated in this preferred form of the invention the input and outputs are not reversed and as such different sized connections 18 and 19 can be specified thus avoiding any confusion on site as to what supply hoses should be connected to which ports 16 and 17.

The hydraulic actuator 15 includes a valve body 20 of substantially rectangular cross-section (see FIG. 5) and incorporating a valve chamber 23 for a valve spool 21. The valve body 20 includes an arrangement of axially and radially extending passages **22*a* and 22*b* communicating with the input and output ports 16 and 17 and the spool valve chamber 23. An arrangement of axially and radially extending supply passages 23*a* and 23*b* are also provided in the valve body, passage 23*a* of which communicates with the spool valve chamber 23 and a passage 23*c* extending axially through the wall of a hydraulic piston-cylinder arrangement 26, which in turn communicates with a chamber 25 within the piston-cylinder arrangement 26. Passage 23*b* also communicates with opposite ends of the spool valve chamber 23 and with a chamber 23 within the piston-cylinder arrangement 26. The arrangement of input and outputs and the passages 22*a* and 22*b* through the valve body 20 relative to the spool valve and the supply passages 23*a*, 23*b* and 23*c* to the chambers 24 and 25 will be readily ascertainable by a person skilled in the art, bearing in mind the required function of achieving admission of pressurised hydraulic fluid to the chamber 24 for a power stroke and to chamber 25 for return stroke in response to an axial shifting of the spool valve 21 in response to an automatic reversing provision to be later described. However, by way of a brief explanation, with the spool valve 21 in the position shown in FIGS. 2 and 4, hydraulic fluid entering through passage 22*a* will flow around spool 21 within the valve chamber 23 and has access to the supply passage 23*b* and into chamber 24 to allow power stroke to be executed by the piston-cylinder arrangement 26. During the power stroke hydraulic fluid in chamber 25 is exhausted through passage 23*c* around the spool 21 in the valve chamber 23 and outwardly through the output passage 22*b*. Upon axial shifting of the spool 21 in a manner to be later described, it adopts the position shown in FIG. 3 at which position hydraulic fluid entering through passage 22*a* and into valve chamber 23 where it has direct access to supply passage 23*c* and into chamber 25 to allow a return stroke to be executed by the piston-cylinder arrangement 26, whilst at the same time hydraulic fluid is exhausted from chamber 24 via the by-pass section of passage 23*b* to the valve chamber 23 adjacent the outer extreme end of the spool 21 where, as shown, it has access to the output passage 22*b***.

The hydraulic piston-cylinder arrangement 26 includes a housing 27 of substantially rectangular cross-section defining the cylinder portion of the arrangement, and one end of which has side extensions **27*a* thereon which are received in grooves 28*a* in the side edges of the end of the valve body 20 (see FIG. 4) and attached thereto by welding, brazing or other suitable provision. Top and bottom extensions 27*b* of the housing member 27 are also received in grooves 28*b* in the end of the valve body 20 (see FIGS. 2 and 3) and attached thereto by welding, brazing or other suitable provision, with the interposing of a sealing ring 29. The other end of the housing 27 terminates at an opening 30 outwardly thereof, whilst the housing is held in position by retaining bolts B passing through the side walls 11 and 12 and into the side walls of the housing 27**.

A piston arrangement 31 axially reciprocates through the opening 30. A main sealing ring 32 is incorporated in the opening 30 to prevent the escape of hydraulic fluid.

The piston arrangement 31 basically comprises an enlarged piston portion 33 one side of which is exposed to pressurised hydraulic fluid admitted to the chamber 24 and has a flange 34 formed thereon in sealing sliding engagement with the inner wall of the surrounding housing 27 and carries a main packing seal **34*a* and secondary O-ring seal 34*b* (see FIG. 4). The piston portion 33 is formed integrally with a tubular portion 35 which extends axially within the cylinder and out through the opening 30 in sliding sealing engagement with the sealing ring 32 and terminates with an integral end wall 36. The outer face 37 of the end wall 36 is of spherical form to cooperate with a slide block arrangement 38** to be later described.

The outer wall of the tubular portion 35 is spaced radially inwardly from the inner wall of the housing 27 thus providing the chamber 25 which has an annular cross section and which when filled with hydraulic fluid under pressure will act only on the small annular surface provided by the exposed face of the flange 34. As discussed previously, if hydraulic fluid under pressure is introduced into chamber 24 and acts on the exposed end face of the piston portion 33 a relatively high force power stroke at low speed will result, whilst when the valve arrangement in the hydraulic actuator section 15 directs pressurised hydraulic fluid to the chamber 25 which has a significantly smaller swept volume, a relatively small force return stroke at high speed will result to achieve the reduction in overall cycle time as previously discussed.

In order to achieve an automatic reversal of hydraulic fluid flow via the valve arrangement to cause the piston arrangement 31 to execute successive power and return strokes, the inner end of the spool valve 21 extends through an aperture 40 in a retainer plate 41 holding the sealing ring 29 in position, and supports a coextensive actuator rod 39 which in turn extends through an aperture **40*a* in a hat shaped washer 41*a*, attached by screws shown to the adjacent end of the piston arrangement 31** and extending into the interior of an axial cavity 43 therein as shown. The actuator rod 39 moves axially within the cavity 43. The inner end of the spool valve 21 has a counter bore 21*a* therein and a compression spring 42*a* is received therein surrounding the actuator rod 39 and, in one relative retracted disposition of the piston portion 33 and the actuator section 15, is compressed between the inner end of the counter bore 21*a* and the hat shaped washer 41*a* (see FIG. 2).

The extreme end of the actuator rod 39 carries a spring retaining member 44 retained against axial movement relative to the rod 39 by a pin 45 therethrough and has a counter bore 44*a* therein. A compression spring 42*b* is received within the counter bore 44*a* and surrounds the actuator rod 39 and in one relative extended disposition of the piston 33 and the actuator section 15 is compressed between the inner end of the counter bore 44*a* and the inner side of the hat shaped washer 41*a* (see FIG. 3). The end of the spool valve remote from the connection to the actuator rod 39 carries a detent member 70 (see FIG. 4) having a pair of axially spaced circumferentially extending grooves 71 and 72 thereabout separated by a circumferential surface, or plane, 73, whilst a pair of spring loaded detent ball arrangements 74 (see FIG. 4) are provided, the balls of which are biased into engagement within one, or the other, of the grooves 71 and 72.

During operation, with the spool 21 of the actuator section 15 in the position shown in FIGS. 2 and 3, pressurised hydraulic fluid is admitted to the chamber 24 which results in the piston and tubular extension 33, 35 executing a power stroke and moves axially along the actuator rod 39, which remains fixed relative to the wrench, to the position shown in FIG. 3. Upon completion of the power stroke the spring 42*b* is fully compressed between the spring retaining member 44 and the hat shaped washer 41*a* whereafter movement is imparted to the actuator rod 39 and the detent balls ride up out of the detent groove 71 and onto the plane 73, whereafter the compressed spring 42*b* asserts itself to continue some movement of the piston arrangement in the power stroke direction to produce further movement of the actuator rod 39, spool 21 and detent member 70 in the power stroke direction to positively shift the spool 21 axially within the valve cavity 23 to cut flow of hydraulic fluid to the chamber 24 and redirect it to the chamber 25, whilst the detent balls move into engagement with the groove 72. Thereafter, the piston proceeds to execute the relatively fast return stroke discussed previously until the inner end of the axial cavity 43 contacts the extreme end of the spring retaining member 44 whilst the spring 42*a* is compressed between the hat shaped member 41*a* and the inner end of the counter bore 21*a* whilst continuing movement of the actuator rod 39 axially shifts the spool valve 21 and causes the detent balls to ride up out of the groove 72 and onto the plane 73, whereafter compressed spring 42*a* asserts itself to continue some movement of the actuator rod 39, spool 21 and detent member 70 in the return stroke direction and positively returns the spool 21 to its original position whilst the detent balls move into engagement with the groove 71 and a successive power stroke will be commenced.

As shown in FIGS. 2 and 3, a freely axially movable and manually operable pin 75*a* extends outwardly through an aperture 13*a* in the end wall 13 with its inner end adapted to move into abutment with the end of the detent member 70 to allow manual shifting, when required, of the spool 21 between the two operative positions allowing admission of hydraulic fluid to either side of the piston arrangement to allow a change from a return to a power stroke.

It will be apparent that with such an arrangement successive power and return strokes will be automatically produced to provide a continuous linear reciprocating movement of the piston assembly outwardly and inwardly of the cylinder 27.

The slide block arrangement 38, which is supported within the body 10, comprises a U-shaped slide block carriage 45. A thrust pad 46 is interposed between the carriage 45, to which it is connected by a dovetail connection 46*a* (see FIG. 4), and the end wall 36 of the tubular extension 35, and has a spherical cavity therein adapted to cooperate with the spherical face 37, and is in turn connected to the extension 35 by a loosely fitting screw S thus providing a spherical seat for floating positioning of the carriage 45 relative to the hydraulic actuator section 15. A ball catch arrangement 47 holds the integers together against inadvertent separation but allows relatively quick release for removal of the carriage 45 from the wrench if required. Between the arms of the U-shaped carriage 45 a thrust member 48, is supported via a pivot pin 49.

The upper leading corner of the thrust member 48 is provided with an arcuate surface 50 which abuts and cooperates with a similarly curved surface 51 on a torque arm 52 pivotally supported in the end of the body and adapted via a ratchet arrangement 53 to drive a stepped output shaft 54 having socket member receiving extensions 55 and 56 at either end and mounted in a large bearing 57*a* and a small bearing 57*b*, which bearings have larger diameter outer flanges as shown. Referring to FIG. 6, apart from the extensions 55 and 56, the output shaft 54 has a large diameter section 54*a*, a mid section 54*b* freely rotatable within the end of the torque arm 52, a spline section 54*c*, and two end sections, one of smaller diameter 54*d* and one of larger diameter 54*e*.

With reference to FIG. 6 of the drawings, the ratchet arrangement 53 comprises a set of ratchet teeth 53*a* extending around one side face of the inner end of the torque arm 52 and about the output shaft 54, cooperating with ratchet teeth on the adjacent side face of a drive member 53*b* fixed to the spline section 54*c* of the shaft 54, with the ratchet teeth being axially biased into engagement by a compression spring 58.

Alternatively the output shaft 54 may be a female spline passing through the wrench such as to be driven either clockwise or anticlockwise, whereby a single socket receiving member may be simply removed from one side and replaced on the other to enable bolts to be loosened or tightened at will, and has the effect of decreasing the overall width of the wrench as there is only one socket receiving extension protruding at any one time.

With the ratchet arrangement 53, the radius of the arrangement can be maximised to minimise the load on the ratchet teeth. Furthermore this form of ratchet arrangement enables a maximum number of teeth to be utilised thereby reducing the amount of rotation of the ratchet arrangement required before reengagement with each successive tooth and thus the ratchet arrangement can be better utilised in confined spaces.

It will be evident that as the slide block member 48 reciprocates under the action of the reciprocations transmitted thereto by the hydraulic actuator section 15 of the wrench, via the carriage 45, the torque arm 52 will be forced upwardly to the position shown in FIG.

3 during power strokes to rotate the output shaft 54 by means of the ratchet arrangement 53, whilst the torque arm 52 cooperates with a torsion spring 59, which biases the torque arm to the position shown in FIG. 2 during the return strokes of the hydraulic actuator, and has one end connected to the torque arm and the other end received and held within a slot 57S in the peripheral edge of the larger bearing 57*a*.

The torque arm 52 incorporates a cavity 60 for the receipt of one end of a manually operable handle 61 (shown in phantom lines in FIG. 2) enabling the wrench to be operated manually, that is, independently of the hydraulic actuator section 15 of the wrench, as discussed previously.

Furthermore, a hardened wear plate 62 is incorporated between the slide carriage 45 and the adjacent surface of the wrench body to minimise wear on the body during use of the wrench.

As shown in FIGS. 1 and 2 in particular, lubricating nipples 63 are provided on the slide block carriage 45 and communicate with a lubricating passage through to the support pin 49, around the support pin and via a further lubricating passage which terminates at the interface between the carriage 45 and the wear plate 62 to thereby lubricate this interface. A further lubricating nipple 64 is provided on the body 10 beneath the wear plate 60 and supplies lubrication through a passage 65 to a felt pad 66 and via a transfer port 67 through the wear plate 62 to the curved surface 51 on the torque arm 52 to allow lubrication of this surface during its sliding contact with the slide block member 48.

A still further lubricating nipple 68 communicates with a radial passage adjacent the output shaft 54 to lubricate the relative moving parts of this section of the wrench.

With reference to FIG. 6 of the drawings, 69 represents a pair of diametrically positioned keeper screws designed to maintain the bearing 57*a* in place and to hold the output assembly in such a position as to ensure alignment of the lubricating nipple 68 with the lubricating passages into this section of the assembly and to enable some pretensioning of the torsion in return spring 59 for the torque arm 52, that is, when the spring is placed in the assembly, the assembly is rotated to tension the spring, with the amount of rotation being readily determined by that required to allow insertion of the keeper screws 69.

Furthermore, with reference to FIGS. 1, 2 and 6 of the drawings, a facility is provided to allow use of the "turn of nut" method or technique, and comprises an annular indicator ring 75, which when unclamped, is freely rotatable about one end of the shaft 54, and adjacent which a clamping ring 76 is provided the outer circumferential edge of which overlaps the inner circumferential edge of the indicator ring 75. Clamping screws 77 are provided, passing through the clamping ring 76 and into threaded holes in the side of the adjacent shaft section 54*e* on the opposite side of the indicating ring and radially inwardly of its inner circumferential edge. With such a facility, after a nut has been tightened a predetermined amount as set by a torque measuring device in series with the torque arm, or by finger tightening, and with the clamping screws 77 loosened, the indicator ring 75 is rotated until the zero mark on the graduated scale (visible in FIGS. 1 and 2) aligns with a reference point on the adjacent bearing 57*a* (in the case the reference point is represented by the slot 57S for receiving the end of the torsion spring 59). The clamping screws 77 are then tightened to clamp the indicating ring to the end of the shaft section 54*e*, whereafter, a tightening torque is applied by the wrench, until a predetermined part of a turn, or number of turns, is applied to the nut or bolt being tightened. With the indicating ring facility on the side of the wrench as illustrated, in order for the indicating ring facility to be visible, it will be evident that the wrench would only by suitable for tightening left hand screw attachments. However the positioning of the facility as indicated is merely for the purposes of illustration and it will be readily apparent that by reversing the arrangement of the components surrounding the output shaft the wrench is better suited for use of the indicating ring facility when tightening conventional right hand screw attachments.

As shown, two cylindrical walls 78 surround and house the shaft and the associated ratchet arrangement 53 and torsion spring 59 in either side of the torque arm 52, and between it and the side walls 11 and 12.

The main body 10 may be manufactured from high tensile alloy steel to allow it to accommodate the high tension forces transmitted through the body during use of the wrench, the side walls 11 and 12 are thickened adjacent the output shaft 54 and the retaining bolts B to strengthen the walls at these points where maximum stress is encountered.

I claim:

1. A torque wrench, including a main body, an actuator supported in said main body, a thrust member acted upon by said actuator to be selectively reciprocated relative to said body, a torque arm supported independently of said thrust member and being physically unconnected thereto, an output shaft, a ratchet arrangement incorporated between said torque arm and said output shaft, said thrust member including a curved surface formed thereon which engages a similarly curved surface on said torque arm during reciprocation of said thrust member to impart a pivotal movement to said torque arm about an axis coincident with the axis of the output shaft for providing a torque which is transferred to said output shaft via said ratchet arrangement.

2. A torque wrench as claimed in claim 1, wherein the actuator is a piston/cylinder arrangement fixed relative to the body of the wrench and cooperating with a valve arrangement which selectively supplies pressurised fluid to either side of the piston member to impart a linear reciprocating movement to said piston member and the thrust member upon which it acts.

3. A torque wrench as claimed in claim 2, wherein the exposed area of the piston on a return side thereof is relatively smaller than the exposed area on the opposite or power side thereof, so that the swept volume during a return stroke is relatively smaller than the swept volume during a power stroke, to thereby produce a low force relatively high speed return stroke and a high force relatively low speed power stroke.

4. A torque wrench as claimed in claim 1, wherein an operating handle is provided and said torque arm includes means for providing connection of said operating handle thereto, whereby a torque output may be manually applied to the output shaft independently of said actuator.

5. A torque wrench as claimed in claim 1, wherein said torque arm cooperates with a return spring which biases the torque arm towards a home position when the thrust member and actuator are in the returned position.

6. A torque wrench as claimed in claim 1, wherein said thrust member has a face of relatively large surface area adapted to engage and slide along a slide support surface of the main body of the wrench during the reciprocation thereof.

7. A torque wrench as claimed in claim 6, wherein a wear plate in the form of an elongated strip of hardened steel is fixed to the main body to provide said slide support surface.

8. A torque wrench as claimed in claim 1, wherein said ratchet arrangement comprises a set of ratchet teeth extending around one side face of said torque arm adjacent said output shaft, and cooperating with a set of ratchet teeth on the side face of an adjacent drive member surrounding said drive shaft and fixed against rotation, but free to move axially, relative thereto, and means for biassing said drive member towards said torque arm to maintain said ratchet teeth in driving engagement.

9. A torque wrench as claimed in claim 1, wherein means are provided to measure the amount of rotation of said output shaft, comprising an indicating ring surrounding said output shaft and having a scale thereon which aligns with a fixed reference point on said wrench, and means for clamping said indicating ring to said output shaft.

10. A torque wrench as claimed in claim 2, wherein said valve arrangement comprises a spool valve including a valve body and a valve spool, said valve spool carrying an actuator rod extending axially into an axially extending cavity within said piston, said actuator rod carrying a spring retaining member at its end remote from said valve spool, a first compression spring surrounding said actuating rod and supported at one end by said retaining member and compressible, between said retaining member and portion of the end of said piston adjacent said valve spool, at least towards the end of a power stroke, a second compression spring surrounding said actuator rod and supported at one end by said valve spool and compressible between said valve spool and said portion of the end of said piston.

11. A torque wrench as claimed in claim 10, wherein the end of said valve spool remote from said piston/-cylinder arrangement carries a detent member having first and second circumferentially extending grooves thereabout separated by a circumferentially extending plane surface, and at least one spring loaded detent ball supported by said valve body and biased into engagement with one or the other of said grooves, whereby towards the end of a power stroke axial movements of said valve spool and said detent member causes the at least one detent ball to ride out of the first of said grooves and onto said plane whereafter said compressed first compression spring asserts itself to positively shift said valve spool and detent member to a position wherein the at least one detent ball engages within said second groove, while toward the end of a return stroke axial movement of said valve spool and said detent member causes the at least one detent ball to move out of the second of said grooves and onto said plane surface whereafter said compressed second compression spring asserts itself to positively shift said valve spool and said detent member into a position where the at least one detent ball engages in said first groove.

12. A torque wrench as claimed in claim 10, wherein a manually axially movable pin extends through an end wall of said valve body and an end wall of said wrench body with its inner end shiftable into contact with the adjacent end of said valve spool to allow manual shifting of said valve spool to a position allowing execution of a return stroke of said piston.

* * * * *